US009744662B1

(12) United States Patent
Henry

(10) Patent No.: US 9,744,662 B1
(45) Date of Patent: Aug. 29, 2017

(54) DOUBLE-PIN LOCKING EXTENSIBLE HANDLE

(71) Applicant: Derek Henry, Ormond Beach, FL (US)

(72) Inventor: Derek Henry, Ormond Beach, FL (US)

( * ) Notice: Subject to any disclaimer, the term of this patent is extended or adjusted under 35 U.S.C. 154(b) by 0 days.

(21) Appl. No.: 15/481,423

(22) Filed: Apr. 6, 2017

Related U.S. Application Data

(60) Provisional application No. 62/359,202, filed on Jul. 7, 2016.

(51) Int. Cl.
*B25G 1/04* (2006.01)

(52) U.S. Cl.
CPC ..... *B25G 1/04* (2013.01)

(58) Field of Classification Search
CPC .... A47L 9/32; B25G 1/04; B25G 3/12; B25G 3/18; B25G 3/04; B05C 17/0205; F16B 7/10; F16B 7/105; F16B 7/042; B21D 39/04; B21D 39/046; B21D 39/048; Y10T 16/473; Y10T 16/4719; Y10T 16/498; Y10T 16/4554; Y10T 403/32467; Y10T 403/598; Y10T 403/7079; Y10T 403/32475; Y10T 15/10
See application file for complete search history.

(56) References Cited

U.S. PATENT DOCUMENTS 4,325,157 A 4/1982 Balint et al.
4,662,771 A 5/1987 Roe et al.
5,385,323 A * 1/1995 Garelick ..... A47C 3/28 248/157
5,515,574 A 5/1996 Larson
5,542,150 A 8/1996 Tu
5,692,856 A 12/1997 Newman et al.
5,983,455 A * 11/1999 Polzin ..... B05C 17/0205 15/144.4
6,079,894 A * 6/2000 Obitts ..... A61H 3/02 135/75
6,158,089 A 12/2000 Monahan et al.
6,254,305 B1 7/2001 Taylor
6,494,492 B1 * 12/2002 Ha ..... A47L 9/244 285/303
6,883,208 B1 * 4/2005 Huang ..... B25G 1/04 16/110.1
7,025,383 B2 * 4/2006 Canale ..... A47L 9/244 285/302
7,774,901 B1 * 8/2010 Huang ..... B25G 1/04 16/113.1

(Continued)

*Primary Examiner* — Chuck Mah
(74) *Attorney, Agent, or Firm* — Louis Ventre, Jr.

(57) ABSTRACT

A telescoping handle includes an outer tubular rod, an inner rod and a lock. The lock is made of a collar; two arc-rings, two retaining covers, and two buttons. The collar slides over the outer tubular rod and the inner rod slides into the other end. A recess in the collar holds two arc-rings that define an inwardly projecting pin sized to pass through the collar and into a hole on the inner rod. Two buttons passing through covers to the recesses enables contact with the two arc-rings causing each projecting pin to withdraw from the inner rod when pushed. When released, each button disengages from the two-arc rings causing the projecting pin to slide into a hole in the inner rod to prevent movement of the inner rod. A spring may be used to bias the two arc-rings into engagement with the inner rod.

5 Claims, 2 Drawing Sheets

(56) References Cited

U.S. PATENT DOCUMENTS

| | | | | |
|---|---|---|---|---|
| 2001/0024594 | A1* | 9/2001 | Taylor | B25G 1/04 403/109.7 |
| 2001/0047570 | A1* | 12/2001 | Lanz | B25G 1/04 16/429 |
| 2005/0050663 | A1* | 3/2005 | Goulet | B05C 17/0205 15/144.4 |
| 2008/0276429 | A1* | 11/2008 | Bukovitz | B25G 3/14 16/429 |
| 2014/0130306 | A1* | 5/2014 | Andel | G01V 3/15 16/429 |
| 2016/0023347 | A1* | 1/2016 | Ho | B25G 1/04 16/429 |

* cited by examiner

DOUBLE-PIN LOCKING EXTENSIBLE HANDLE

CROSS-REFERENCE TO RELATED APPLICATIONS

This application claims the benefit of U.S. Provisional Application No. 62/359,202, filed 7 Jul. 2016, which is hereby incorporated by reference herein.

TECHNICAL FIELD

In the field of miscellaneous hardware, a telescoping handle is intended to be attached to a number of implements where the telescoping handle has a mechanism connected therewith to provide capability to extend the length thereof to an operative position and to return such to a non-extended position.

BACKGROUND ART

Telescoping poles typically use a standard twist-locking cam, which consists of a primary pole with a threaded collar that compresses the secondary pole when the cam is twisted. In a similar structure, other telescoping poles use an off-centered inner pole which when twisted engages with the outer pole to frictionally lock the poles together. These threaded and compression type locking features that are complex in operation, are subject to jamming due to debris and wear rapidly reducing their utility.

Yet other variations utilize a movable ball bearing that engages in sockets in the inner pole when a collar at the junction of the two nested poles is twisted. Here again twisting action is needed to engage the lock using a complicated mechanism with a disconnected ball bearing.

A locking mechanism has been described that employs an internal leaf spring within the inner rod. The internal leaf spring causes a detent to engage each time the detent meets a hole in the outer rod. This locking mechanism requires that a person press to push the detent out of the hole each time the detent meets a hole in the outer rod and auto engages with it. There is no means to hold the detent in a disengaged position while making changes in length that spans more than one hole in the outer rod. This art does not provide for release of the lock by pushing and holding of buttons during adjustment of handle length beyond the distance between holes.

SUMMARY OF INVENTION

A telescoping handle includes an outer tubular rod, an inner rod and a lock. The inner rod has two sets of linearly-aligned holes formed about 180 degrees apart along an axial direction. The inner rod has two channels formed in the axial direction centered on one of the two sets of linearly-aligned holes. The lock is made of a collar; two arc-rings, two retaining covers, and two buttons. The collar has a first section that slides over one end of the outer tubular rod and a second section that allows the inner rod to slide co-axially within the collar and then to slide into the outer tubular rod. The second section has a 360-degree recess in the outside surface used to hold two arc-rings. The second section also has two rails projecting inwardly from the inside surface and extending axially within the second section. The rails engage channels in the inner rod. Each of the two rails has a hole that aligns with any one of the linearly-aligned holes in the inner rod. Each of the two arc-rings defines an inwardly projecting pin sized to pass through the hole in either rail and into one of the holes on the inner rod in order to prevent the inner rod sliding axially within the collar. Each of the two retaining covers has two half-button-passageways that create two button-passageways when the two retaining covers are joined together. The two retaining covers fit over the 360-degree recess and prevent the two arc-rings from slipping out of the 360-degree recess. Two buttons fit within one of the two button-passageways so that when pushed, each button contacts the two arc-rings causing each projecting pin to withdraw from the inner rod. When released, each button disengages from the two-arc rings causing the projecting pin to reinsert into a hole in the inner rod to prevent movement of the inner rod. A spring may be used to bias the two arc-rings so that the projecting pin engages with the inner rod. A cap on the end of the inner rod may be used to prevent the inner rod from passing through the collar when the handle is collapsed. When the inner rod is tubular, an extender rod may be slidably inserted into the inner rod to create another extension segment.

Technical Problem

A lock for an extensible pole is needed that does not employ a twisting action to engage or disengage the lock.

One problem with the prior art utilizing twisting of the nested poles, or twisting a collar connecting the nested poles, in order to lock them together is that it is almost always either too loose or too tight, causing slippage during operation or interfering with ease of use and readjustment of the handle.

Another problem with the prior art utilizing twisting of the nested poles, or twisting a collar connecting the nested poles, is that the mechanism is prone to get jammed by dirt or other contaminants.

The locking mechanism on existing extensible handles can disengage from torsional forces operating on the tool at the end of the handle. For example, when used in painting, the offset of the roller and the pressure due to application of the roller on a wall can unintentionally twist the poles and cause them to loosen or disengage from their locked relative position.

Twisting nested poles to lock them can require significant effort on the part of the user. A locking mechanism is needed that does not require significant user strength to operate.

A lock for an extensible pole is needed that auto-engages when the pins and holes in an inner rod align.

Releasing the lock on an extension pole can require significant force and be difficult for some users. A simple two-button release would replace the need to exert a twisting force with a simple press of buttons to disengage the locking pins.

Existing locking mechanisms that auto-engage, require that the user disengage the lock each time a pin passes a hole when extending or contracting the handle. This can be a tedious and frustrating effort when a lengthy extension or contraction of the handle is needed.

Extensible rods using a ball and detent arrangement are dependent upon the movement of the ball with the twisting apparatus. These type locks for extensible rods are relatively costly to produce. Also, the locking mechanism is susceptible to contaminants being entrapped therein resulting in lock inoperability.

Solution to Problem

The solution is a locking mechanism that does not use twisting motion to lock the nested poles together.

The solution is further a locking mechanism based on employing two arc-rings facing end to end so that they are movable with the push of two buttons on opposing sides.

The solution is the use of two structural pins that are an integral part of the two arc-rings, which provide a lock based on resistance to shear forces.

The solution is a lock using two structural pins positioned on opposite sides of the nested poles to provide a force balance to the lock.

The solution is a lock using two structural pins that cannot be unlocked by normal torsional forces acting on the nested poles.

The solution is an auto-engaging lock that enables a user to disengage the tubes for sliding to any desired length with one press and hold of the releasing buttons.

Advantageous Effects of Invention

The invention satisfies a need for an easily-operated extensible-pole handle that doubly locks the nested poles in any of multiple reach positions without twisting the poles together.

Double locking achieved by two structural shear pins acting on opposite sides of the nested poles increases the strength of the extended pole due to forces acting in the axial direction, such as when used to pull or push on a tool.

Double locking provides assurance that the locking mechanism will not accidentally disengage due to torsional forces that occur when using the nested poles with a tool having an offset from the axial direction, such as with a paint roller.

Providing two auto-engaged locking pins structurally fixed on two arc-rings avoids having to twist the two poles to lock or unlock them for telescoping the handle to a different length.

Providing two buttons in combination with two arc-rings enables pushing and holding the buttons to remove the pin from the hole and then adjust the telescoping poles to the desired length, eliminating the need to disengage the lock each time the pin passes a hole in the inner pole.

Two push-buttons that release the poles to slide in or out imparts a sturdy, rigid tactile feel and delivers positive feedback in an operator's fingers to the operability of the lock and its release mechanism.

The double-pin locking extensible handle is cost effective in that it may be made in a wide range of materials, the most common of which are aluminum and fiberglass for the poles, with any number of thermoplastics for smaller parts (e.g., Acrylonitrile butadiene styrene (ABS), Polyoxymethylene (POM), Polyethylene (PE), etc.).

BRIEF DESCRIPTION OF DRAWINGS

The drawings illustrate preferred embodiments of the double-pin locking extensible handle according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate preferred embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
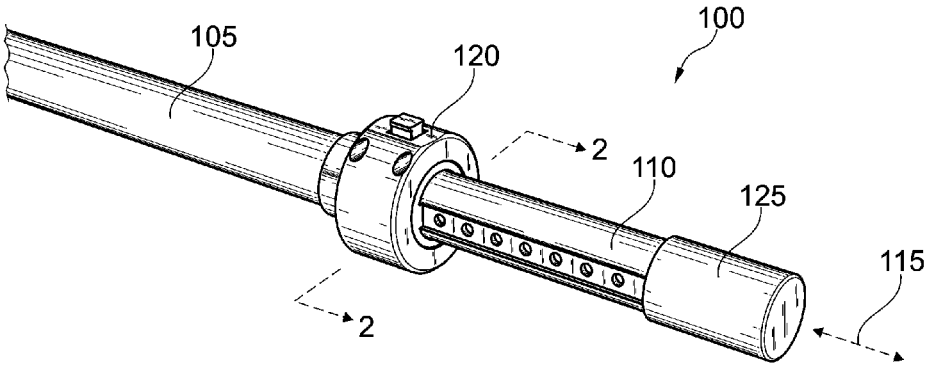
FIG. 1 is a perspective view of a preferred embodiment of the double-pin locking extensible handle.

FIG. 1 is a perspective view of a preferred embodiment of the double-pin locking extensible handle, also referred to herein as a telescoping handle (100). The telescoping handle (100) includes an outer tubular rod (105), an inner rod (110), and a lock (120). The term "rod" and "pole" are used interchangeable herein.

The outer tubular rod (105) may have any cross-section suitable for a tube. A tube is preferably defined as a long, hollow pipe defining an enclosed volume surrounding a central axis. For example, the outer tubular rod (105) may have a cylindrical shape defined by circular cross-section. In another example, the outer tubular rod (105) may have a rectangular cross-section. In another example, the outer tubular rod (105) may have a star cross-section. In general, the outer tubular rod (105) may have any other cross-section meeting the functional requirements set forth herein for the telescoping handle (100). Preferably, the outer tubular rod (105) has a ribbed surface for grip retention, while the inner rod (110) is smooth to ensure ease of sliding. Preferably, the outer tubular rod (105) terminates with a set of holes or a threaded projection to accept paint rollers, nets, brushes, saws, and other attachments.

The inner rod (110) may also be tubular or it may be a solid bar. Preferably, to reduce weight, the inner rod (110) is a tubular rod. The inner rod (110) defines two sets of linearly-aligned holes (305A) and (305B) where each set of linearly-aligned holes is formed about 180 degrees apart along an axial direction (115). The phase "about 180 degrees" is intended to convey the concept that these two sets of linearly-aligned holes (305A) and (305B) are generally on opposite halves of the inner rod (110). The purpose being that when two opposing holes (one hole in each of the two sets of linearly-aligned holes (305A) and (305B)) are used when the lock (120) is activated, they generally provide a nearly balanced force locale, which doubly prevents the inner rod (110) from sliding in an axial direction.

The inner rod (110) further defines two channels (310A) and (310B) formed in the axial direction (115). Each of the two channels (310A) and (310B) is preferably centered on one of the two sets of linearly-aligned holes (305A) and (305B). Thus, preferably, each set in the two sets of linearly-aligned holes (305A) and (305B) is centered within the two channels (310A) and (310B).

The lock (120) includes a collar (225); two arc-rings (230A) and (230B); two retaining covers (235A) and (235B); and two buttons (240A) and (240B). The lock is the means to doubly hold the inner rod (110) in place, to prevent the inner rod (110) from sliding in an axial direction, and to release the inner rod (110) to slide to either retract or extend the telescoping handle (100).

The collar (225) is shaped with at least two sections. A first section (345) and a second section (346). The first section (345) is configured to slide co-axially over a first end (350) of the outer tubular rod (105). The first section (345) is, thus, similar in function to a plastic inside flush coupling commonly used to water drainage service. Thus, the first section (345) is, preferably, shaped to be a compatible female receptor to the outside surface of the outer tubular rod (105).

The second section (346) of the collar (225) is configured to permit the inner rod (110) to slide co-axially within the collar (225) and then to slide into the outer tubular rod (105). Sliding is preferably constrained to within a defined path with respect to the collar (225). In order to limit this sliding path, the second section (346) defines two rails (360A) and (360B) that project inwardly and extend axially within the second section (346). Each of the two rails (360A) and (360B) is configured to extend into one of the two channels (310A) and (310B) on inner rod (110) when the inner rod (110) is present in the collar (225). Preferably, each of the two rails (360A) and (360B) is concaved in nature and aligned with a set of drainage holes near the terminus of the outer tubular rod (105). This shape serves to form canals between the rails and the inner rod (110) to facilitate water drainage from the inner rod (110) and improve grip retention.

The second section (346) of the collar (225) further defines a 360-degree recess (355). The 360-degree recess (355) is configured to limit the movement of the two arc-rings (230A) and (230B) in an axial direction within the second section (346). Thus, each of the two arc-rings (230A) and (230B) fits into the 360-degree recess (355) in the second section (346) of the collar (225).

Each of the two rails (360A) and (360B) defines an aperture (205A) and (205B) that aligns with any one of the linearly-aligned holes in one of the two sets of linearly-aligned holes (305A) and (305B) in the inner rod (110) when the inner rod (110) is present in the collar (225). Thus, each of the two rails (360A) and (360B) also serves to reinforce the telescoping handle (100) where the shear force is focused to prevent the sliding or movement of the inner rod (110) into the outer tubular rod (105).

Each of the two arc-rings (230A) and (230B) defines a concave inner surface (365) and a convex outer surface (370). The concave inner surface (365) mates with the shape of the 360-degree recess (355). The convex outer surface (370) may extend in a radial direction beyond the recess as long as the axial sliding direction of each of the two arc-rings (230A) and (230B) is limited by the recess, i.e., the recess walls and the two arc-rings (230A) and (230B) are constrained in an outward radial direction by the two retaining covers (235A) and (235B).

Each of the two arc-rings (230A) and (230B) defines a detent (375A) and (375B). Each detent (375A) and (375B) is preferably a pin that extends from the concave inner surface (365) and is immovable with respect to the arc-ring from which it extends. Immovability, as examples, may be achieved by embedding a steel or other metal pin in each of the two arc-rings (230A) and (230B), by molding a single piece arc-ring and detent from spring steel, by welding, gluing, or by any other attachment method known in the art. Each detent (375A) and (375B) may also be referred to as a shear pin because engaged with the inner rod (110), they operate to resist shear forces acting in the axial direction (115). The terms "detent," "pin" and "shear pin" are thus interchangeably used herein.

Each detent (375A) and (375B) is sized to pass through the aperture (205A) and (205B) in one of the two rails (360A) and (360B). The aperture (205A) and (205B) and the detent (375A) and (375B) preferably have a compatible cross-sectional shape to enable each detent (375A) and (375B) to easily pass through the aperture (205A) and (205B).

Each detent (375A) and (375B) is further sized to enter any one of the linearly-aligned holes in one of the two sets of linearly-aligned holes (305A) and (305B) on the inner rod (110), where such entry physically prevents further sliding of the inner rod (110) within the collar (225). Thus, detent (375A) is configured to slide in the aperture (205A) within the rail (360A) in the second section (346) of the collar (225). Also, detent (375B) is configured to slide in the aperture (205B) within the rail (360B) in the second section (346) of the collar (225). Sliding of the detent (375A) and (375B) in the aperture (205A) and (205B), respectively, occurs in a radial direction. The detent (375A) and (375B) slides in the aperture (205A) and (205B) on its way to either enter or withdraw from one of the holes in each of the two sets of linearly-aligned holes (305A) and (305B) defined by the inner rod (110). Preferably, the two arc-rings (230A) and (230B) are made of spring material that is shaped to bias the detent (375A) and (375B) into engagement with the inner rod (110) and to disengage with the inner rod when the two buttons (240A) and (240B) are pushed.

Figure 2:
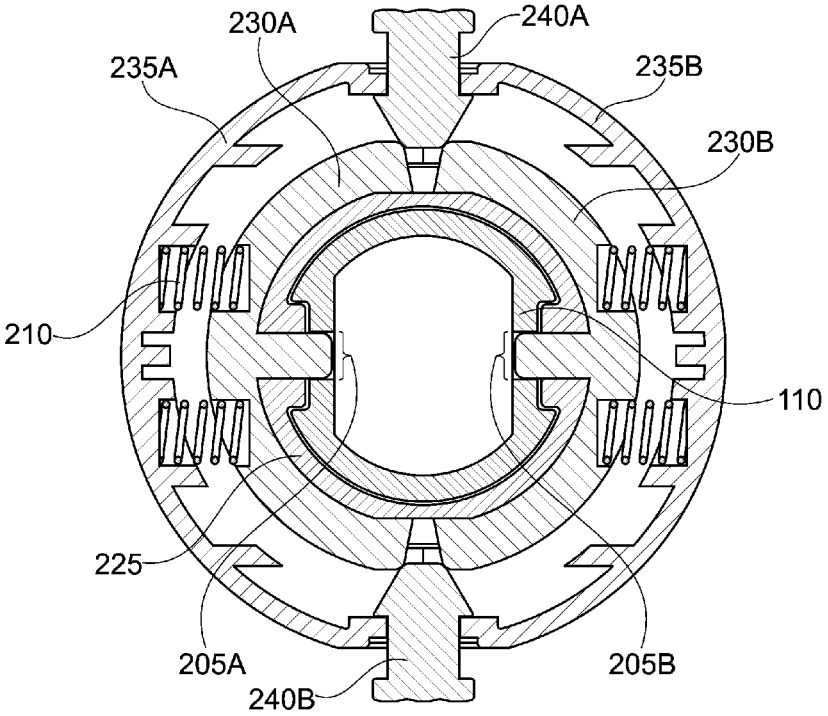
FIG. 2 is a sectional view of the double-pin locking extensible handle of FIG. 1 taken at the center of the lock as shown in FIG. 1.
Figure 3:
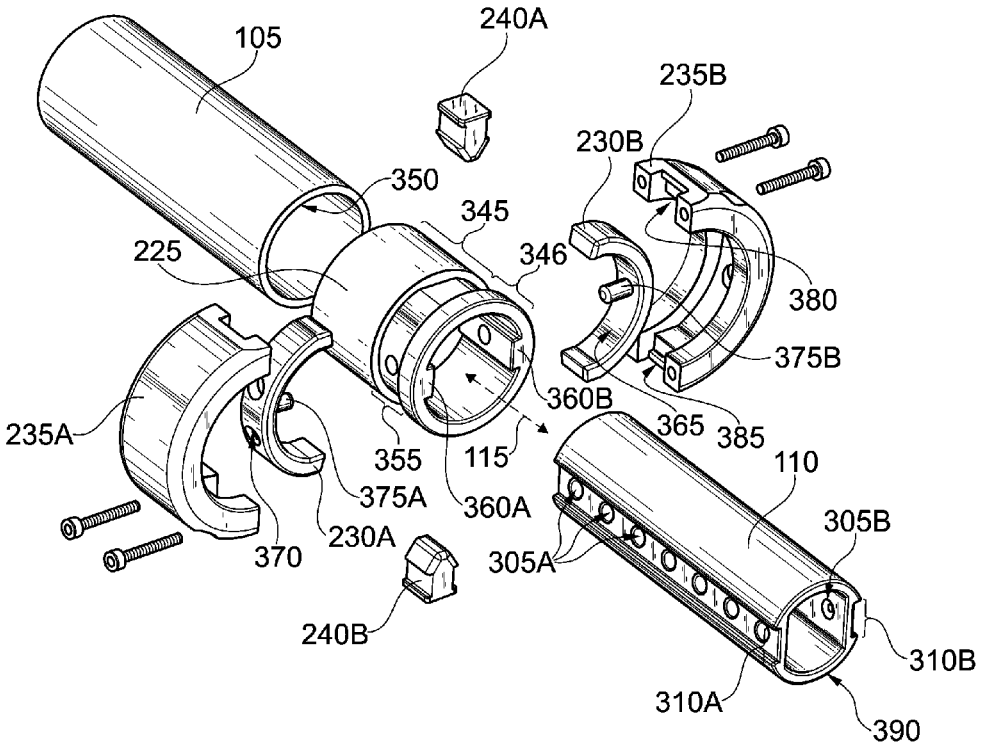
FIG. 3 is an exploded view of the double-pin locking extensible handle of FIG. 1.
Figure 4:
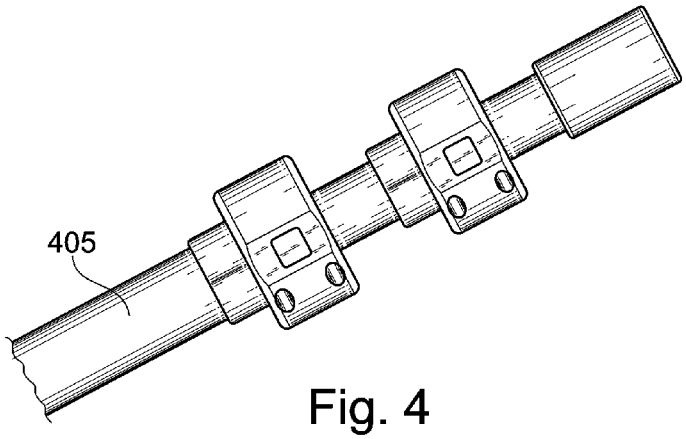
FIG. 4 is a perspective view of an optional extender rod.

In an alternative embodiment, a spring (210) is used to bias the detent (375A) and (375B) into engagement with the inner rod (110). Thus, in this alternative embodiment there is at least a spring (210) for each of the two arc-rings (230A) and (230B), each spring (210) acting to bias the detent (375A) and (375B) into engagement with the inner rod (110) when the inner rod (110) is present in the collar (225). Preferably, there are 4 springs as shown in FIG. 2

Each of the two retaining covers (235A) and (235B) is configured with two half-button-passageways (380) and (385). The two retaining covers (235A) and (235B) have shapes that are essentially mirror images of each other. When the two retaining covers (235A) and (235B) are joined together the half-button-passageways create two button passageways.

Each of the two retaining covers (235A) and (235B) is further configured to fit over the 360-degree recess (355) and prevent the two arc-rings (230A) and (230B) from slipping out of the 360-degree recess (355). The two retaining covers (235A) and (235B) are preferably secured in place and together by screws.

Each of the two buttons (240A) and (240B) is configured to fit within one of the two button-passageways formed when the two retaining covers (235A) and (235B) are joined together. The fit is such that when pushed, each said button contacts the two arc-rings (230A) and (230B) causing each detent (375A) and (375B) to withdraw from the inner rod (110) when the inner rod (110) is present in the collar (225);

Each of the two buttons (240A) and (240B) is configured so that when released, each said button disengages from the two-arc rings causing each detent (375A) and (375B) to enter into any one of the linearly-aligned holes in one of the two sets of linearly-aligned holes (305A) and (305B) on the inner rod (110) when the inner rod (110) is present in the collar (225).

The telescoping handle (100) may include a cap (125) on a distal end (390) of the inner rod (110). The cap (125) is configured to prevent the distal end (390) from entering the collar (225).

When the inner rod (110) is tubular, the telescoping handle (100) may further include an extender rod (405), configured to be slidably inserted into the inner rod (110). The extender rod is a means to create further handle extension by means of another nested rod that can be extended out of the inner rod (110). An additional, locking member may be included with this extender rod (405).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the hardware industry.

What is claimed is:

1. A telescoping handle comprising:

an outer tubular rod;

an inner rod;

the inner rod defining:

two sets of linearly-aligned holes, each set of linearly-aligned holes formed about 180 degrees apart along an axial direction;

two channels formed in the axial direction, each of the two channels centered on one of the two sets of linearly-aligned holes;

a lock, the lock comprising: a collar; two arc-rings; two retaining covers; and two buttons;

the collar configured with two sections, the two sections comprising:

a first section configured to slide co-axially over a first end of the outer tubular rod; and a second section configured to permit the inner rod to slide co-axially within the collar and then to slide into the outer tubular rod;

the second section defining a 360-degree recess;

the second section comprising two rails projecting inwardly and extending axially within the second section;

each of the two rails defines an aperture that aligns with any one of the linearly-aligned holes in one of the two sets of linearly-aligned holes in the inner rod when the inner rod is present in the collar; and each of the two rails is configured to extend into one of the two channels on inner rod when the inner rod is present in the collar;

each of the two arc-rings fits into the 360-degree recess in the second section of the collar;

each of the two arc-rings defines a concave inner surface and a convex outer surface;

each of the two arc-rings defines a detent;

each said detent extends from the concave inner surface and is immovable with respect to the arc-ring from which it extends;

each detent is sized to pass through the aperture in one of the two rails;

each detent is further sized to enter any one of the linearly-aligned holes in one of the two sets of linearly-aligned holes on the inner rod, where such entry physically prevents further sliding of the inner rod within the collar;

each of the two retaining covers is configured with:

two half-button-passageways that create two button-passageways when the two retaining covers are joined together; and to fit over the 360-degree recess and prevent the two arc-rings from slipping out of the 360-degree recess;

each of the two buttons is configured:

to fit within one of the two button-passageways;

so that when pushed, each said button contacts the two arc-rings causing each detent to withdraw from the inner rod when the inner rod is present in the collar;

so that when released, each of the two buttons disengages from the two-arc rings causing each detent to enter into any one of the linearly-aligned holes in one of the two sets of linearly-aligned holes on the inner rod when the inner rod is present in the collar.

2. The telescoping handle of claim 1, further comprising a spring for each of the two arc-rings, each spring acting to bias the detent into engagement with the inner rod when the inner rod is present in the collar.

3. The telescoping handle of claim 1, further comprising a cap on a distal end of the inner rod, said cap configured to prevent the distal end from entering the collar.

4. The telescoping handle of claim 1, wherein the inner rod is tubular.

5. The telescoping handle of claim 4, further comprising an extender rod configured to be slidably inserted into the inner rod.

* * * * *